US007442264B2

(12) United States Patent
Ropital et al.

(10) Patent No.: US 7,442,264 B2
(45) Date of Patent: Oct. 28, 2008

(54) METHOD OF USING LOW ALLOY ANTICOKING STEELS WITH AN INCREASED SILICON AND MANGANESE CONTENT IN REFINING AND PETROCHEMICALS APPLICATIONS

(75) Inventors: Francois Ropital, Rueil Malmaison (FR); Xavier Longaygue, Noisy le Roi (FR)

(73) Assignee: Institute Francais du Petrole, Rueil Malmaison Cedex (FR)

( * ) Notice: Subject to any disclaimer, the term of this patent is extended or adjusted under 35 U.S.C. 154(b) by 418 days.

(21) Appl. No.: 10/787,900

(22) Filed: Feb. 27, 2004

(65) Prior Publication Data

US 2004/0234409 A1 Nov. 25, 2004

(30) Foreign Application Priority Data

Feb. 27, 2003 (FR) ..... 03 02434

(51) Int. Cl.
*C22C 38/38* (2006.01)
*C22C 38/34* (2006.01)
*C22C 38/22* (2006.01)

(52) U.S. Cl. ..... 148/325; 148/327; 148/329; 148/334; 148/337

(58) Field of Classification Search ..... 148/537, 148/333, 334, 327, 325, 329, 337, 909; 420/74, 420/57, 46, 105, 117–120, 72, 67, 69, 70, 420/111
See application file for complete search history.

(56) References Cited

U.S. PATENT DOCUMENTS 3,674,468 A * 7/1972 Ota et al. ..... 420/34
3,847,600 A 11/1974 Mimino et al.
3,929,428 A 12/1975 Nishi et al.

(Continued)

FOREIGN PATENT DOCUMENTS

DE 2701565 7/1978
EP 0338133 10/1989

(Continued)

*Primary Examiner*—Deborah Yee
(74) *Attorney, Agent, or Firm*—Millen, White, Zelano, Branigan, P.C.

(57) ABSTRACT

The use is described, in the fabrication of apparatus and equipment used in refining and in petrochemicals (for example furnace, reactor or line elements), of a steel composition comprising:
at most 0.25% C;
more than 1% up to 10% Mn;
1.5% to 5% Si;
at most 0.03% P;
at most 0.03% S;
4% to 10% Cr;
0.5% to 2% Mo;
at most 0.40% V; and
at most 0.10% N;
the complement to 100% being essentially iron.

Steels comprising:
at most 0.15% C;
more than 2% up to 10% Mn;
1.5% to 5% Si;
at most 0.03% P;
at most 0.03% S;
4% to 10% Cr;
more than 0.5% up to 2% Mo;
at most 0.40% V; and
at most 0.10% N;
the complement to 100% being essentially iron; are themselves novel.

34 Claims, 1 Drawing Sheet

U.S. PATENT DOCUMENTS

| | | | | | |
|---|---|---|---|---|---|
| 4,129,442 | A | | 12/1978 | Horiuchi et al. | |
| 4,721,600 | A | * | 1/1988 | Maehara et al. | 420/57 |
| 5,011,656 | A | | 4/1991 | Ohori et al. | |
| 5,278,881 | A | * | 1/1994 | Kato et al. | 376/305 |
| 5,665,669 | A | * | 9/1997 | Yamanaka et al. | 502/439 |
| 5,693,155 | A | | 12/1997 | Mousseaux et al. | |
| 6,235,238 | B1 | | 5/2001 | Lecour et al. | |
| 6,749,894 | B2 | * | 6/2004 | Subramanian et al. | 427/239 |
| 2002/0129876 | A1 | | 9/2002 | Lecour et al. | |

FOREIGN PATENT DOCUMENTS

| | | | |
|---|---|---|---|
| EP | 0718415 | | 6/1996 |
| EP | 1223230 | | 7/2002 |
| FR | 2776671 | | 10/1999 |
| GB | 419009 | | 11/1934 |
| GB | 517118 | | 1/1940 |
| GB | 1220620 | | 1/1971 |
| JP | 02254135 | | 12/1990 |
| JP | 404006247 | * | 1/1992 |

* cited by examiner

METHOD OF USING LOW ALLOY ANTICOKING STEELS WITH AN INCREASED SILICON AND MANGANESE CONTENT IN REFINING AND PETROCHEMICALS APPLICATIONS

The invention relates to the use of low alloy anticoking steels with an increased silicon and manganese content in refining and petrochemicals applications, and to novel steel compositions for use in those applications.

French patent application FR-A-2 776 671 describes a low alloy Cr—Mo steel with low sensitivity to catalytic coking due to the controlled addition of silicon.

More particularly, the steels considered had the following composition by weight: at most 0.25% C, 1.5% to 5% Si, 4% to 10% Cr, 0.5% to 2% Mo, 0.3% to 1% Mn, at most 0.030% S and at most 0.03% P, the complement to 100% being essentially iron. Such steels could also contain at most 0.40% V and at most 0.10% N.

The beneficial role of silicon, for example in a minimum amount of about 2% in the bulk steel composition, has been demonstrated using thermogravimetric tests under environmental conditions simulating refining processes: catalytic reforming and isobutane dehydrogenation.

Unfortunately, although it does not degrade steel processing properties such as forgeability, silicon has an embrittling effect which results in lower resilience (energy at break, Charpy test) in the final product. Such brittleness has been observed in different silicon-enriched castings, hot rolled and characterized mechanically, quenched and tempered. It should be recalled that tempering is the last treatment applied to the metal; it allows the mechanical properties of the steel to be adjusted; we thus see a HV30 hardness of about 250 Vickers and a yield point Re in the range 500 to 600 MPa. Table 1 below illustrates the fact that the presence of silicon substantially degrades the resilience Kv, while hardness HV and yield strength Rp are little different from that of the reference casting. Such brittleness runs the risk of limiting the use of silicon-containing grades in fabricated equipment used in refining.

TABLE 1

| Casting | % Si | Rp (MPa) | Kv, 20° C. (J) |
|---|---|---|---|
| A (reference) | 0.450 | 525 | 150 |
| B | 2.164 | 575 | 8-12 |
| C | 2.934 | 600 | 3-5 |
| D | 3.770 | 600 | 2 |

Since silicon-containing grades have slightly better tensile characteristics than the reference, a first means envisaged to attempt to overcome the brittleness problem consisted of applying more severe heat treatments. However, this would have the disadvantage of rendering the industrial fabrication process more difficult and incurring additional costs (heat treatments are an expensive part of manufacturing) with no guarantee of success regarding the anticipated outcome.

The aim of the present invention is to propose the use of low alloy anticoking steels in the fabrication of apparatus and equipment used in refining and petrochemicals. The steels used have improved resilience without reducing the yield strength. These latter are factors to be taken into consideration when deciding equipment dimensions, and reduction thereof would be risky.

These aims are accomplished in the invention by the provision of low alloy steels that are enriched in both manganese and in silicon.

In a first aspect, the invention envisages the use of certain steel compositions in the fabrication of apparatus and equipment used in refining and in petrochemicals (in particular furnace, reactor and line elements). The steel compositions used in the invention are characterized in that they comprise:

at most 0.25% C;
more than 1% up to10% Mn;
1.5% to 5% Si;
at most 0.03% P;
at most 0.03% S;
4% to 10% Cr;
0.5% to 2% Mo;
at most 0.40% V; and
at most 0.10% N;
the complement to 100% being essentially iron.

In accordance with the invention, it is possible to fabricate the elements intended for the fabrication of furnaces, reactors or lines as a bulk piece. Said steels can be produced using conventional foundry and casting methods, then formed by the usual techniques to fabricate sheet, grates, tubes, profiles, rings or plate. Such semi-finished products can be used to construct the principal parts of furnaces, reactors or lines, or only accessory or auxiliary parts thereof.

It is also possible to use the steel of the invention to coat the internal walls of a furnace, reactor or line using at least one technique selected from co-centrifuging, plasma, PVD, CVD, electrolytic techniques, overlay and plating.

The apparatus or equipment fabricated using steels with the composition defined above can be destined for refining or petrochemicals processes carried out at temperatures of 350° C. to 1100° C., for example catalytic cracking, thermal cracking or dehydrogenation. As an example, during the catalytic reforming reaction, which produces a reformate at temperatures of 450° C. to 650° C., a secondary reaction causes the formation of coke. This coke formation is catalytically activated by the presence of nickel, iron and/or their oxides.

A further application may be isobutane dehydrogenation, which produces isobutene at temperatures of 550° C. to 700° C.

In a second aspect, the invention consists of novel steel compositions characterized in that they comprise:

at most 0.15% C;
more than 2% up to 10% Mn, preferably 2.25% to 10% Mn;
1.5% to 5% Si;
at most 0.03% P;
at most 0.03% S;
4% to 10% Cr;
more than 0.5% up to 2% Mo;
at most 0.40% V; and
at most 0.10% N;
the complement to 100% being essentially iron.

In the compositions of the invention, the ratio Mn/Si is preferably in the range 1.5/1 to 3/1.

BRIEF DESCRIPTION OF THE DRAWING

The invention will be better understood, and its advantages will become clearer, from the following non-limiting example and tests, illustrated in the accompanying figures, in which.

EXAMPLE

Preparation of Castings

Castings were produced under industrial conditions using a Mn/Si ratio in the range 1.5/1 to 3/1. These castings were hot rolled then underwent a quench and temper treatment. They had the compositions given in Table 2 below:

TABLE 2

| Casting | C | Mn | Si | P | S | Cr | Mo | V | N |
|---|---|---|---|---|---|---|---|---|---|
| A (ref) | 0.130 | 0.465 | 0.458 | 0.016 | 0.003 | 8.890 | 0.977 | 0.050 | 0.008 |
| I | 0.124 | 5.250 | 1.924 | 0.016 | 0.004 | 8.900 | 0.978 | 0.050 | 0.008 |
| II | 0.120 | 5.770 | 2.224 | 0.016 | 0.005 | 8.800 | 0.964 | 0.050 | 0.0085 |
| III | 0.133 | 4.884 | 2.699 | 0.013 | 0.004 | 8.210 | 0.902 | 0.047 | 0.589 |
| IV | 0.117 | 7.990 | 3.111 | 0.014 | 0.005 | 8.470 | 0.933 | 0.049 | 0.0085 |

Coking Tests

Figure 1:
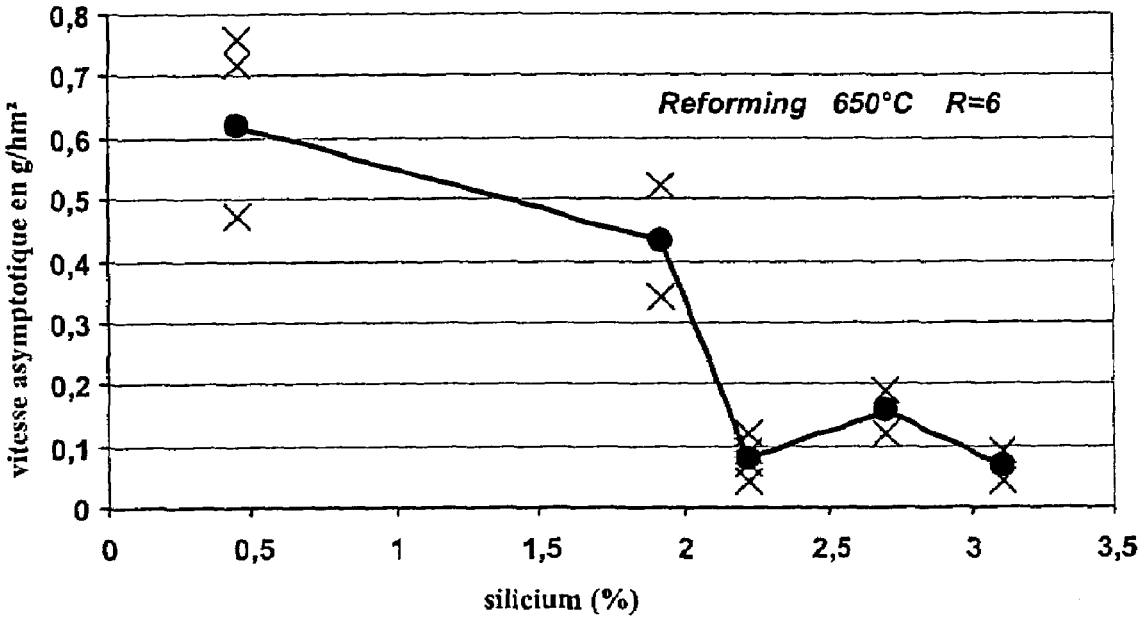
FIG. 1 shows the results of coking which confirm the beneficial effect of silicon on Mn—Si castings.

At the end of these treatments, it can be seen that the degree of coking (under catalytic reforming conditions) was maintained compared with steels that did not contain manganese: adding manganese thus does not call into question the favourable effect of silicon; FIG. 1 shows the coking results which confirm the beneficial effect of silicon on Mn—Si castings.

Mechanical Tests

Mechanical tests were carried out to provide a comparison with silicon castings with no added manganese, the compositions of which are given in the following table:

TABLE 3

| Casting | C | Mn | Si | P | S | Cr | Mo | V | N |
|---|---|---|---|---|---|---|---|---|---|
| B | 0.127 | 0.471 | 2.164 | 0.015 | 0.0053 | 9.15 | 1.104 | 0.007 | 0.0111 |
| C | 0.150 | 0.473 | 2.934 | 0.014 | 0.0058 | 9.08 | 1.002 | 0.008 | 0.0364 |
| D | 0.119 | 0.451 | 3.770 | 0.015 | 0.0051 | 9.05 | 0.997 | 0.007 | 0.0090 |

To illustrate the gain as regards brittleness linked to the addition of manganese, the parameter adopted was the product of hardness and resilience (energy at break at 20° C.). These two properties are antagonistic: the harder the material (and more resistant to traction) the higher the risk of brittleness; in contrast, extending the heat treatment to reduce the brittleness results in a reduction in both hardness and in tensile strength.

Figure 2:
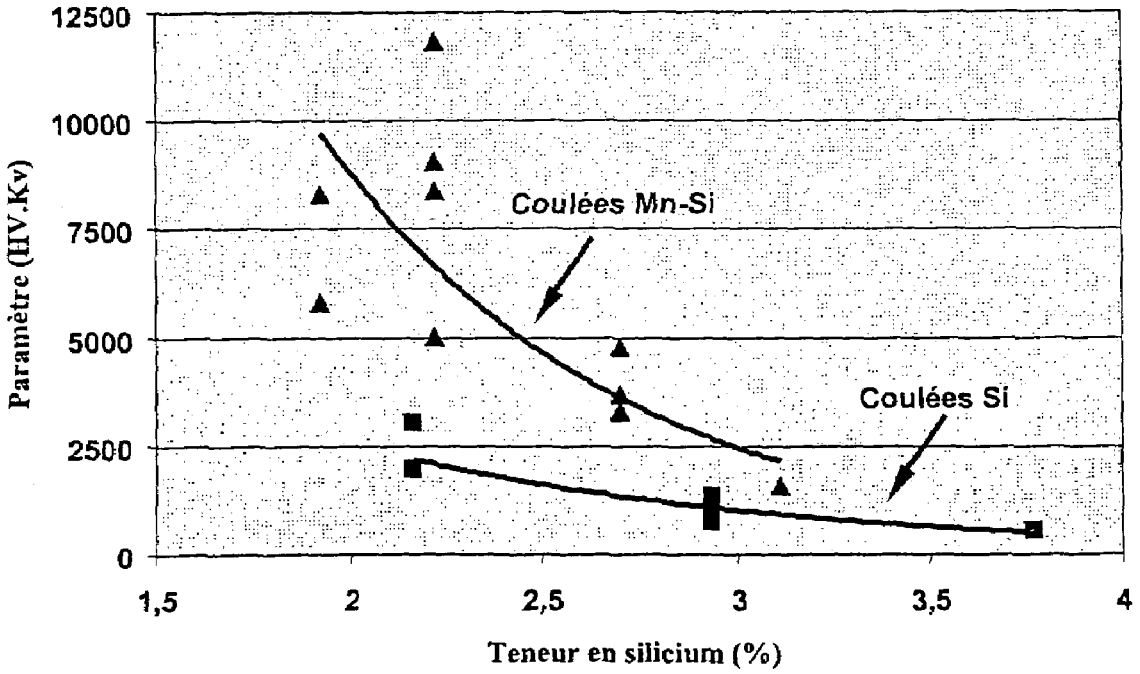
FIG. 2 provides a direct comparison of "Si" castings and "Mn—Si" castings using the parameter (HV.Kv).

FIG. 2 provides a direct comparison of "Si" castings (with compositions B, C and D) and "Mn—Si" castings (with compositions I, II, III and IV) using the parameter (HV.Kv). The variation in this parameter is shown as a function of the silicon content of the steel. The favourable effect of manganese can be seen especially with silicon contents below 2.5%. For a content in the range 2.0% to 2.5%, sufficient from the point of view of anticoking, the parameter (HV.Kv) is multiplied by a factor of 2 to 5.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure of all applications, patents and publications, cited herein and of corresponding French application No. 03/02.434, filed Feb. 27, 2003, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. In a naphtha catalytic reforming process carried out at temperature of 450° C. to 650° C. or an isobutane dehydrogenation process carried out at temperature of 550° C. to 700° C., the improvement comprising performing said naphtha catalytic reforming process or isobutane dehydrogenation process in a furnace, reactor or tube, entirely or partially fabricated with a steel made from an alloy comprising:

at most 0.25% C;
more than 2.0% up to 10% Mn;
1.5% to 5% Si;
at most 0.03% P;
at most 0.03% S;
4% to 10% Cr;
0.5% to 2% Mo;
at most 0.40% V; and
at most 0.10% N;
the complement to 100% being essentially iron, and with the provision that the alloy has an Mn/Si ratio in the range of 1.5/1 to 3/1,
wherein said alloy exhibits anticoking properties.

2. A process according to claim 1, wherein said furnace, reactor or tube is fabricated as a bulk piece from said steel.

3. A process according to claim 1, wherein said furnace, reactor or tube is coated with said steel.

4. A process according to claim 3, wherein said furnace, reactor or tube is coated with said steel by co-centrifuging, plasma, PVD, CVD, an electrolytic technique, overlay or plating.

5. A process according to claim 1, wherein said alloy comprises:

at most 0.15% C;
more than 2.0% up to 10% Mn;
2% to 2.5% Si;
at most 0.03% P;
at most 0.03% S;
4% to 10% Cr;
more than 0.5% up to 2% Mo;
at most 0.40% V; and
at most 0.10% N;
the complement to 100% being essentially iron, with the provision that the alloy has an Mn/Si ratio in the range of 1.5/1 to 3/1.

6. A process according to claim 5, wherein said naphtha catalytic reforming process or isobutane dehydrogenation process is conducted in a reactor susceptible to coking.

7. A process according to claim 6, wherein a naphtha catalytic reforming process carried out at temperatures of 450° C. to 650° C. is conducted in said reactor.

8. A process according to claim 6, wherein an isobutane dehydrogenation process carried out at temperatures of 550° C. to 700° C. is conducted in said reactor.

9. A process according to claim 5, wherein said alloy contains about 5-6% Mn.

10. A process according to claim 9, wherein said naphtha catalytic reforming process or isobutane dehydrogenation process is conducted in a reactor susceptible to coking.

11. A process according to claim 10, wherein a naphtha catalytic reforming process carried out at temperatures of 450° C. to 650° C. is conducted in said reactor.

12. A process according to claim 10, wherein an isobutane dehydrogenation process carried out at temperatures of 550° C. to 700° C. is conducted in said reactor.

13. A process according to claim 5, wherein said alloy consists of:

at most 0.15% C;
more than 2.0% up to 10% Mn;
2% to 2.5% Si;
at most 0.03% P;
at most 0.03% S;
4% to 10% Cr;
more than 0.5% up to 2% Mo;
at most 0.40% V;
at most 0.10% N,
with the provision that the alloy has an Mn/Si ratio in the range of 1.5/1 to 3/1
the complement to 100% being iron.

14. A process according to claim 1, wherein said alloy contains 0.008% N or less.

15. A process according to claim 5, wherein said alloy contains 0.008% N or less.

16. A process according to claim 13, wherein said alloy contains 0.008% N or less.

17. A process according to claim 5, wherein said alloy contains more than 4.8% up to 10% Mn.

18. A process according to claim 13, wherein said alloy contains more than 4.8% up to 10% Mn.

19. A process according to claim 17, wherein said alloy contains 0.008% N or less.

20. A process according to claim 18, wherein said alloy contains 0.008% N or less.

21. A process according to claim 1, wherein said alloy consists of:

at most 0.25% C;
more than 2.0% up to 10% Mn;
1.5%to 5% Si;
at most 0.03% P;
at most 0.03% S;
4% to 10% Cr;
0.5% to 2% Mo;
at most 0.40% V; and
at most 0.10% N;
the complement to 100% being essentially iron, and with the provision that the alloy has an Mn/Si ratio in the range of 1.5/1 to 3/1.

22. A process according to claim 1, wherein said alloy contains 2.2-2.7 % of Si and 0.008% of N or less.

23. A process according to claim 1, wherein said process is a naphtha catalytic reforming process carried out at temperature of 450° C. to 650° C.

24. A process according to claim 2, wherein said process is a naphtha catalytic reforming process carried out at temperature of 450° C. to 650° C.

25. A process according to claim 3, wherein said process is a naphtha catalytic reforming process carried out at temperature of 450° C. to 650° C.

26. A process according to claim 4, wherein said process is a naphtha catalytic reforming process carried out at temperature of 450° C. to 650° C.

27. A process according to claim 22, wherein said process is a naphtha catalytic reforming process carried out at temperature of 450° C. to 650° C.

28. A process according to claim 1, wherein said process is an isobutane dehydrogenation process carried out at temperature of 550° C. to 700°.

29. A process according to claim 2, wherein said process is an isobutane dehydrogenation process carried out at temperature of 550° C. to 700°.

30. A process according to claim 3, wherein said process is an isobutane dehydrogenation process carried out at temperature of 550° C. to 700°.

31. A process according to claim 4, wherein said process is an isobutane dehydrogenation process carried out at temperature of 550° C. to 700°.

32. A process according to claim 22, wherein said process is an isobutane dehydrogenation process carried out at temperature of 550° C. to 700°.

33. A process according to claim 1, wherein said alloy contains 0.12% to 0.25% C.

34. A process according to claim 1, wherein said alloy contains 0.05% to 0.4 V.

* * * * *

UNITED STATES PATENT AND TRADEMARK OFFICE

CERTIFICATE OF CORRECTION

PATENT NO. : 7,442,264 B2
APPLICATION NO. : 10/787900
DATED : October 28, 2008
INVENTOR(S) : Francois Ropital It is certified that error appears in the above-identified patent and that said Letters Patent is hereby corrected as shown below:

Column 5, line 27, claim 13 reads "3/1" should read -- 3/1, --
Column 5, line 47, claim 21 reads "1.5%to" should read -- 1.5% to --
Column 6, line 45, claim 34 reads "0.4 V." should read -- 0.4% V. --

Signed and Sealed this

Twenty-second Day of September, 2009

David J. Kappos

David J. Kappos
*Director of the United States Patent and Trademark Office*